United States Patent [19]

Colvin

[11] Patent Number: 4,716,797

[45] Date of Patent: Jan. 5, 1988

[54] SCREWDRIVER WITH CONCAVE BLADE

[76] Inventor: David S. Colvin, 23933 Haynes, Farmington Hills, Mich. 48018

[21] Appl. No.: 898,207

[22] Filed: Aug. 20, 1986

[51] Int. Cl.[4] ..... B25B 15/00

[52] U.S. Cl. ..... 81/436

[58] Field of Search ..... 81/436; D8/82, 86; 7/165

[56] References Cited

U.S. PATENT DOCUMENTS

| | | | |
|---|---|---|---|
| 432,928 | 7/1890 | Bartlett | 81/436 |
| 1,479,506 | 1/1924 | Kelleman | 81/436 |
| 2,782,823 | 2/1957 | Williams | D8/82 |
| 4,452,289 | 6/1984 | Smith | D8/86 |

*Primary Examiner*—Robert P. Olszewski
*Assistant Examiner*—Bradley I. Vaught
*Attorney, Agent, or Firm*—Brooks & Kushman

[57] ABSTRACT

A screwdriver (10) disclosed includes a handle (12), an elongated shaft (14) having a central axis (A) and also having a transverse thickness D and a blade (22) unitary with the shaft extending thereof away from the handle along the central axis. The blade (22) includes a main portion (24) and a tip (26) connected to the main portion and has oppositely facing continuously curved concave surfaces (28) that taper toward each other away from the thickness D of the shaft (14) to the tip.

6 Claims, 4 Drawing Figures

SCREWDRIVER WITH CONCAVE BLADE

TECHNICAL FIELD

This invention relates to screwdrivers.

BACKGROUND ART

The blade geometry of a conventional screwdriver has oppositely facing planar blade surfaces that converge to a tip. This construction causes the screwdriver to cam out of the screw slot when rotative force is applied to screws resistant to turning. In an effort to minimize this tendency, the application of increased axial pressure in the direction of the screw is necessary when torque is being applied. In addition, the blade geometry creates point contact between the screwdriver and the screw slot and this together with the camming effect frequently causes deformation of the screw slot and an impediment to reuse of the screw.

Specially designed screwdrivers have previously incorporated oppositely facing parallel or diverging blade tip surfaces. Although these screwdrivers maintain screw head contact with less axial pressure applied than is necessary with the conventional blade construction, the tips of such screwdrivers have always been so thin and thus structurally weak as to be susceptible to breakage. This is a particular problem when such screwdrivers are used as prys or chisels, as often is done.

Specially designed screwdriver-screw head systems facilitate screwdriver-screw engagement with less axial pressure than conventional screwdrivers and screw heads. However, a system that requires a screw head to be shaped to accommodate a particular screwdriver is not readily acceptable by consumers and industry.

Prior art patents noted by the investigation conducted for the present invention are described below.

U.S. Pat. No. 67,014 to Ayres for Screwdriver discloses a screw driver having a dove-tailed edge on its tip to facilitate screw head engagement.

U.S. Pat. No. 260,795 to Smith for Screw discloses a screw having a projection in the center of the screw slot and a screwdriver having a notch in the tip to hold the screwdriver in the screw slot.

U.S. Pat. No. 417,722 to Hart for Screw Driver discloses a screw driver having sunk portions at the opposite sides of the blade which engage the screw slot.

U.S. Pat. No. 1,056,095 to Groos for Screw Driver discloses a screw driver having two transverse grooves on each surface of the screw driver tip to engage corresponding portions of the undercut groove in the screw head.

U.S. Pat. No. 1,361,790 to Brown for Valve And Grinding Mechanism Therefor discloses a valve and a valve grinding tool. The Brown valve includes a groove therein that has a curved bottom and side walls that incline toward each other from the bottom of the groove to the top of the valve. The Brown valve grinding tool includes an integral tongue shaped in conformity with and adapted to fit the groove in the valve.

U.S. Pat. No. 1,479,506 to Kelleman for Screw Driver discloses a screwdriver having concave, hollow ground, oppositely facing tip surfaces. Oppositely facing planar surfaces extend from the tip surfaces toward the handle with a tapering to the nominal thickness of the screwdriver shaft connected to the handle.

U.S. Pat. No. 2,684,094 to Lissy for Nonslip Screw Driver and Screwhead discloses a screw head having undercut walls and a screw driver having outwardly flared projections for increasing the grip with the screw.

U.S. Pat. No. 2,792,039 to Wing et al for Slotted Screw Head and Driver Therefor Having Non-Burring Engagement discloses a combination screw head and a driver for the screw head where the screwdriver has a arcuate edge and side walls comprising surfaces of revolution diverging from each other toward said edge to engage with undercut portions of the screw slot.

U.S. Pat. No. 2,994,354 to Vaughn for Improved Screw Driver discloses a screwdriver having an arcuate bottom and parallel or converging oppositely facing tip surfaces for use with screw head slots provided with undercut non-planar surfaces.

U.S. Pat. Nos. 3,026,920 and 3,120,251 to York are each entitled Screwdriver and disclose screwdrivers having convex arcuate tips and concave opposite bearing surfaces defined by generally planar surface portions.

U.S. Pat. Nos. 3,897,812 and 3,923,088 to Arnn for Screw Driver and Biting Screw Driver each disclose a screwdriver having a foot portion shaped as an isosceles trapezoid in cross section to increase the gripping force with a screw slot.

U.S. Pat. No. 4,311,071 to Bassell for Screw Driver and Screw Head System discloses in combination a screw head and screw driver having oppositely facing diverging tip faces for engagement with the undercut side walls of the screw slot.

DISCLOSURE OF INVENTION

An object of the present invention is to provide an improved screwdriver which minimizes the axial pressure required to maintain screwdriver screw head contact while maintaining the structural integrity of a conventional screwdriver tip.

In carrying out the above object, a screwdriver constructed in accordance with the invention comprises a handle and an elongated shaft having a central axis and also having a first end connected to the handle as well as a second end spaced from the handle. The elongated shaft has a transverse thickness D and a blade having a tip and also having a main portion extending from the second end away from the handle along the central axis. The blade is defined by oppositely facing continuously curved concave surfaces that taper toward each other from the thickness D at the second end of the shaft to the tip.

In the preferred embodiment, the blade extends from the second end of the shaft away from the handle along the central axis for a length in the range of about 3.5 D to 6.5 D. Also, each oppositely facing concave surface is defined by a circular arc having a radius of a length of about 40 D to 120 D and the center of the circular arc is positioned along a perpendicular to the central axis with the perpendicular having a junction with the central axis at a location between the tip and a distance 4 D from the tip in a direction away from the handle. In this construction, the tip thickness between the oppositely facing concave surfaces is in the range of about 0.15 D to 0.25 D.

In the most preferred construction, the blade extends away from the second end of the elongated shaft for a length of about 5 D and the radius of each circular arc has a length of about 80 D. The center of each circular arc along the perpendicular to the central axis has a junction at a location spaced a distance of about 1 D from the tip, and the tip thickness between the oppositely facing hollow ground surfaces is about 0.2 D.

Such a screwdriver allows the user to apply a minimal amount of axial pressure in order to maintain screwdriver contact with a screw head when torque is applied to the screw. This feature together with the creation of improved line contact between the screwdriver tip and the screw slot substantially reduces the possibility of deformation of the screw head. Also, when the screwdriver invention is used as a pry or chisel, as many screwdrivers are, the improved blade geometry gives the screwdriver the structural integrity of a conventional screwdriver and the possibility of tip breakage associated with specially designed screwdrivers is substantially reduced.

The above object and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
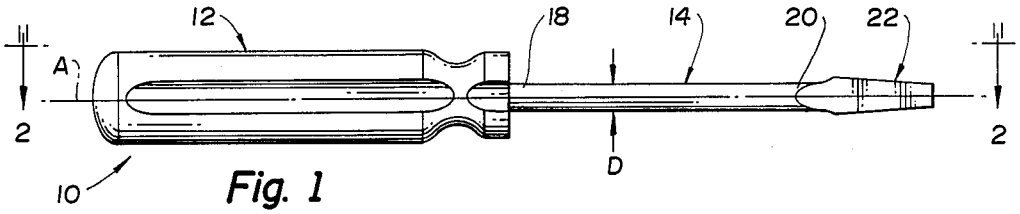
FIG. 1 is a front view of a screwdriver constructed according to the present invention.

Referring to FIG. 1 of the drawings, a screwdriver constructed in accordance with the present invention is generally indicated by 10 and is used to loosen or tighten screw headed fasteners. As is more fully hereinafter described, the screwdriver 10 includes an improved blade construction that reduces the axial pressure needed to maintain contact with a screw head slot while still having the strength of conventional screwdriver blades with flat tapered surfaces.

Figure 2:
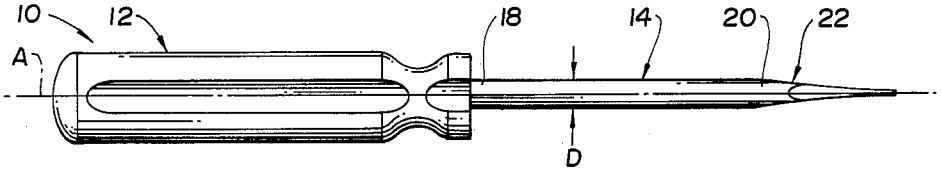
FIG. 2 is a side view of the screwdriver taken along the direction of line 2—2 in FIG. 1.

As seen in both FIGS. 1 and 2, the improved screwdriver 10 includes a handle 12 and an elongated shaft 14 having a central axis A. Shaft 14 has a first end 18 connected to the handle 12 as well as a second end 20 spaced from the handle. The elongated shaft 14 has a transverse thickness D and a blade 22 unitary with the shaft extending from the second end 20 away from the handle 12 along the central axis A.

Figure 3:
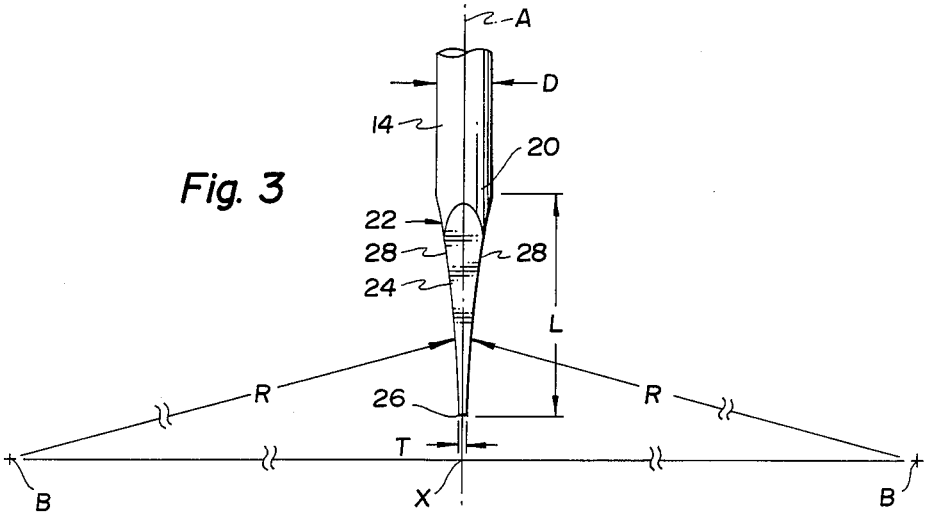
FIG. 3 is an enlarged side view of the screwdriver shaft end and blade.

As illustrated in FIG. 3, the blade 22 includes a main portion 24 and a tip 26 connected to the main portion. The blade 22 has oppositely facing continuously curved concave surfaces 28 that taper toward each other the entire axial distance from the thickness D at the second end 20 of the elongated shaft 14 to the tip 26.

In the preferred construction of the screwdriver blade 22 shown in FIG. 3, the blade extends from the second end 20 of the elongated shaft 14 away from the screwdriver handle along the central axis A for a length L in the range of about 3.5 D to 6.5 D. Each oppositely facing concave surface 28 is defined by a circular arc having a radius R of a length in the range of about 40 D to 120 D and the center B of each circular arc is positioned along a perpendicular to the central axis A with the perpendicular having a junction X with the central axis at a location between the tip 26 and a distance 4 D from the tip in a direction away from the away from the handle 12 shown in FIGS. 1 and 2. Preferably, the tip 26 has a thickness T between the oppositely facing continuously curved surfaces 28 in the range of about 0.15 D to 0.25 D.

Figure 4:
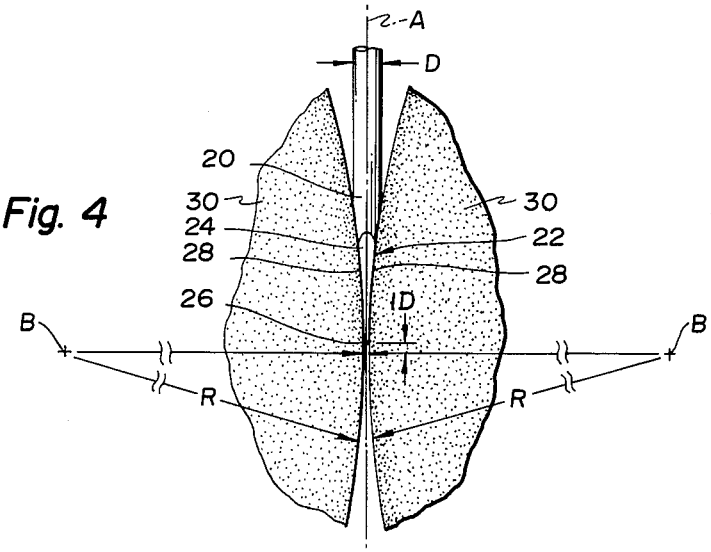
FIG. 4 is a partial view illustrating how the screwdriver is ground.

FIG. 4 illustrates the grinding process used to provide the oppositely facing concave surfaces 28 of the blade 22. The oppositely facing concave surfaces 28 are ground to the shape illustrated by inserting the blade 22 between two grinding wheels 30 that are spaced slightly from each other and have radii R equal to the radii of the resultant blade arcs. The two grinding wheels 30 have axes of rotation B that are parallel to each other and are spaced apart slightly to provide the blade tip construction described above.

To perform the grinding, a screwdriver blank with flat blade surfaces is inserted between the grinding wheels 30 with its axis A perpendicular to a line between the rotational centers B of the grinding wheels. This insertion continues until the desired tip thickness is ground when the tip is located a distance with 1 D from the line between the centers of the grinding wheel axes B.

In the most preferred construction, the blade 22 shown in FIG. 3 extends away from the second end 20 of the elongated shaft 14 for a length L of about 5 D. In this most preferred construction, the radius R of each circular arc has a length of about 80 D and the line between the centers of the circular arcs has a junction with the axis A at a location spaced a distance of about 1 D from the tip 26 as previously mentioned. Also, the tip 26 most preferably has a thickness T between the oppositely facing continuously curved concave surfaces 28 of about 0.2 D.

With the screwdriver construction disclosed, the tip 26 maintains contact with a screw head slot with less axial pressure than is required with conventional screwdrivers. When the screwdriver is used as a pry or chisel, the blade construction and specifically the tip thickness thereof provides the required strength to withstand such misuse.

While the best mode for carrying out the invention has been described in detail, those familiar with the art to which this invention relates will recognize various alternative designs and embodiments for practicing the invention as defined by the following claims.

What is claimed is:

1. A screwdriver comprising: a handle; an elongated shaft having a central axis and also having a first end connected to the handle as well as a second end spaced from the handle; said elongated shaft having a transverse thickness D; a blade unitary with the shaft extending from the second end thereof away from the handle along the central axis for a length of about 5 D; said blade including a main portion and a tip connected to the main portion; the blade having oppositely facing continuously curved concave surfaces tapering toward each other from the thickness D at the second end of the shaft to the tip; each oppositely facing concave surface being defined by a circular arc having a radius of a length of about 80 D; each circular arc having a center positioned along a perpendicular to the central axis with the perpendicular having a junction with the central axis at a location spaced a distance of about 1 D from the tip in a direction away from the handle; and the tip having a thickness between the oppositely facing concave surfaces of about 0.2 D.

2. A screwdriver comprising: a handle; an elongated shaft having a central axis and also having a first end connected to the handle as well as a second end spaced from the handle; said elongated shaft having a transverse thickness D; a blade unitary with the shaft extending from the second end thereof away from the handle along the central axis for a length in the range of about 3.5 D to 6.5 D; said blade including a main portion and a tip connected to the main portion; the blade having oppositely facing continuously curved concave surfaces tapering toward each other from the thickness D at the second end of the shaft to the tip; each oppositely facing concave surface being defined by a circular arc having a radius of a length in the range of about 40 D to 120 D; each circular arc having a center positioned along a perpendicular to the central axis with the perpendicular having a junction with the central axis at a location between the tip and a distance 4 D from the tip in a direction away from the handle; and the tip having a thickness between the oppositely facing concave surfaces in the range of about 0.15 D to 0.25 D.

3. A screwdriver as in claim 2, wherein the blade extends away from the second end of said elongated shaft for a length of about 5 D.

4. A screwdriver as in claim 2, wherein the radius of each circular arc has a length of about 80 D.

5. A screwdriver as in claim 2, wherein the center of each circular arc along the perpendicular thereof to the central axis has a junction therewith at a location spaced a distance of about 1 D from the tip.

6. A screwdriver as in claim 2, wherein the tip thickness between the oppositely facing concave surfaces is about 0.2 D.

* * * * *

UNITED STATES PATENT AND TRADEMARK OFFICE

CERTIFICATE OF CORRECTION

PATENT NO. : 4,716,797

DATED : January 5, 1988

INVENTOR(S) : David S. Colvin

It is certified that error appears in the above-identified patent and that said Letters Patent is hereby corrected as shown below:

Column 4, line 1, delete "away from the" (first occurrence).

Column 4, line 21, change "with" to --about--.

Signed and Sealed this

Fifteenth Day of November, 1988

*Attest:*

*Attesting Officer*

DONALD J. QUIGG

*Commissioner of Patents and Trademarks*